US009689268B2

(12) United States Patent
Deallenbach et al.

(10) Patent No.: US 9,689,268 B2
(45) Date of Patent: Jun. 27, 2017

(54) TURBINE BUCKET CLOSURE ASSEMBLY AND METHODS OF ASSEMBLING THE SAME

(71) Applicant: General Electric Company, Schenectady, NY (US)

(72) Inventors: Robert Edward Deallenbach, Flat Rock, NC (US); Ravichandran Pazhur Nair, Glenville, NY (US); Douglas Arthur Lupe, Ballston Spa, NY (US)

(73) Assignee: General Electric Company, Schenectady, NY (US)

( * ) Notice: Subject to any disclaimer, the term of this patent is extended or adjusted under 35 U.S.C. 154(b) by 614 days.

(21) Appl. No.: 14/109,549

(22) Filed: Dec. 17, 2013

(65) Prior Publication Data

US 2015/0167469 A1 Jun. 18, 2015

(51) Int. Cl.

| | |
|---|---|
| ***F01D 5/32*** | (2006.01) |
| ***F01D 5/22*** | (2006.01) |
| ***F01D 5/30*** | (2006.01) |

(52) U.S. Cl.

CPC ..... *F01D 5/225* (2013.01); *F01D 5/3007* (2013.01); *F01D 5/326* (2013.01); *F05D 2250/13* (2013.01)

(58) Field of Classification Search

CPC . F01D 5/225; F01D 5/32; F01D 5/326; F01D 5/323; F01D 5/3007; F05D 2250/13

See application file for complete search history.

(56) References Cited

U.S. PATENT DOCUMENTS

| | | | | |
|---|---|---|---|---|
| 5,509,784 | A | 4/1996 | Caruso et al. | |
| 6,030,178 | A | 2/2000 | Caruso | |
| 6,416,286 | B1 | 7/2002 | Roberts et al. | |
| 6,827,554 | B2 * | 12/2004 | Caruso | F01D 5/3007 416/191 |
| 7,182,577 | B2 * | 2/2007 | Yamashita | F01D 5/225 29/889.21 |
| 7,270,518 | B2 | 9/2007 | Barb et al. | |
| 7,344,359 | B2 | 3/2008 | Deallenbach et al. | |
| 9,175,570 | B2 * | 11/2015 | Propheter-Hinckley | F01D 5/22 |
| 9,347,326 | B2 * | 5/2016 | Kim | F01D 5/303 |
| 2005/0249599 | A1 * | 11/2005 | Hemsley | F01D 5/225 416/204 R |
| 2009/0290983 | A1 * | 11/2009 | Tanaka | F01D 5/225 416/179 |
| 2012/0177498 | A1 * | 7/2012 | Yarava | F01D 5/323 416/220 R |

* cited by examiner

*Primary Examiner* — Richard Edgar
*Assistant Examiner* — Jesse Prager
(74) *Attorney, Agent, or Firm* — Armstrong Teasdale LLP

(57) ABSTRACT

A rotor wheel assembly has a rotor wheel including a plurality of dovetail slots. The rotor wheel assembly includes a bucket closure assembly having a leading auxiliary bucket with a dovetail coupled to a dovetail slot and an integral cover having a back side edge oriented at a first angle relative to the rotor wheel rotation axis. The bucket closure assembly includes a closure bucket having a dovetail coupled to a dovetail slot and an integral cover having a front side and a back side edge, where the back side edge is oriented to a second angle and the front side edge is parallel to the back side edge of the leading auxiliary bucket. The bucket closure assembly includes a trailing auxiliary bucket having a dovetail coupled to a dovetail slot and an integral cover having a front side edge parallel to the back side edge of the closure bucket.

9 Claims, 6 Drawing Sheets

TURBINE BUCKET CLOSURE ASSEMBLY AND METHODS OF ASSEMBLING THE SAME

BACKGROUND OF THE INVENTION

The present invention relates generally to turbine engines, and more particularly, to an axial entry integrally shrouded turbine bucket closure assembly.

In at least some known turbine engines, such as gas turbines and steam turbines, axial entry buckets, i.e., rotor blades, are coupled to a rotor wheel by sliding the buckets generally parallel to the rotor axis and into mating dovetails formed on the rotor wheel. Some known buckets include radially-inwardly projecting dovetails that mate in dovetails on the rotor wheel. The rotor wheel dovetails are circumferentially spaced apart from each other about the periphery of the rotor wheel.

Some known turbines, however, use integral covers or shrouds along the bucket tips. Generally, the shrouds have overlapping protrusions that nest with the shrouds of adjacent buckets. Some known shrouds may have a Z-shaped configuration when viewed in a radially-inward direction. As the buckets are assembled around the rotor wheel using the axial entry dovetail system, the shrouds of the first and the next to the last assembled buckets may prevent assembly of the final axial entry bucket. The blocking portions of the shrouds cannot be removed because the shrouds are designed to fit tightly together and in contact with each other to maintain a continuous circumferential coupling of the buckets at their tips. As a result, the clearance between the shrouds on the buckets adjacent to the closure bucket location is insufficient to permit axial insertion of the closure bucket.

To facilitate insertion of the final axial entry bucket, at least some known turbines use a dovetail closure insert to secure the closure bucket. However, using a dovetail closure insert increases the cost of such known turbines and may also increase operating stresses induced in the bucket to the rotor wheel assembly. As such, known methods of securing the final or closure bucket with its shroud to the otherwise completed rotor wheel assembly by the axial entry assembly method may be difficult and time-consuming, and may increase operating stresses on the turbine.

BRIEF DESCRIPTION OF THE INVENTION

In one aspect, a rotor wheel assembly is provided. The rotor wheel assembly includes a rotor wheel having a plurality of dovetail slots spaced circumferentially about a periphery of the rotor wheel. The rotor wheel assembly also has a bucket closure assembly. The bucket closure assembly includes a leading auxiliary bucket coupled to the rotor wheel. The leading auxiliary bucket has a dovetail configured to attach to a respective one of the plurality of dovetail slots. Furthermore, the leading auxiliary bucket has an integral cover including a first back side circumferential edge oriented at a first angle relative to an axis of rotation of the rotor wheel. In addition, the bucket closure assembly includes a closure bucket coupled to the rotor wheel. The closure bucket has a dovetail configured to attach to a respective one of the plurality of dovetail slots and an integral cover with a second back side circumferential edge and a first front side circumferential edge. The first front side circumferential edge is oriented substantially parallel to the first back side edge, and the second back side circumferential edge is oriented at a second angle relative to the axis of rotation. The second angle is inclined in the same direction as the first angle. Furthermore, the bucket closure assembly includes a trailing auxiliary bucket coupled to the rotor wheel. The trailing auxiliary bucket has a dovetail configured to attach to a respective one of the plurality of dovetail slot. The trailing auxiliary bucket also has an integral cover including a second front side circumferential edge oriented substantially parallel to the second back side circumferential edge. The first back side circumferential edge is coupled in mating engagement to the first front side circumferential edge, and the second back side circumferential edge is coupled in mating engagement to the second front side circumferential edge.

In another aspect, a turbine engine is provided. The turbine engine includes a rotatable shaft having an axis of rotation. The turbine engine also includes a casing extending circumferentially about the rotatable shaft. The casing defines at least one passage configured to channel a working fluid along a length of the rotatable shaft. The turbine engine also includes a rotor wheel assembly attached to a portion of the rotatable shaft for rotation therewith. The rotor wheel assembly is configured to expand the working fluid. The rotor wheel assembly includes a rotor wheel having a plurality of dovetail slots spaced circumferentially about a periphery of the rotor wheel. Furthermore, the rotor wheel assembly includes a plurality of buckets arranged in a circumferential array about the axis of rotation. Each of the buckets includes a dovetail configured to attach to a respective one of the plurality of dovetail slots, a platform portion, an airfoil portion, and an integral cover formed integrally with the bucket. The rotor wheel assembly includes a bucket closure assembly configured to close and secure the circumferential array of buckets. The bucket closure assembly has a trailing auxiliary bucket including a dovetail configured to attach to a respective one of the plurality of dovetail slots, a platform portion, an airfoil portion, and an integral cover formed integrally with the trailing auxiliary bucket. The integral cover includes a first circumferential width configured to generate an interference condition with an adjacent integral cover. The integral cover has a first front side circumferential edge and a first back side circumferential edge wherein the first back side circumferential edge is oriented at a first angle relative to the axis of rotation, and the first front side circumferential edge is oriented at a second angle relative to the axis of rotation. Furthermore, the closure bucket assembly includes a closure bucket having a dovetail configured to attach to a respective one of the plurality of dovetail slots, a platform portion comprising a keyway, an airfoil portion, and an integral cover formed integrally with the closure bucket. The integral cover includes a second circumferential width configured to generate an interference condition with an adjacent integral cover. The integral cover also has a second front side circumferential edge and a second back side circumferential edge where the second back side circumferential edge is oriented substantially parallel to the first back side circumferential edge, and the second back side circumferential edge is oriented substantially parallel to the first front side circumferential edge.

DETAILED DESCRIPTION OF THE INVENTION

As used herein, the terms "axial" and "axially" refer to directions and orientations extending substantially parallel to a longitudinal axis of a turbine engine. Moreover, the terms "radial" and "radially" refer to directions and orientations extending substantially perpendicular to the longitudinal axis of the turbine engine. In addition, as used herein, the terms "circumferential" and "circumferentially" refer to directions and orientations extending arcuately about the longitudinal axis of the turbine engine.

Figure 1:
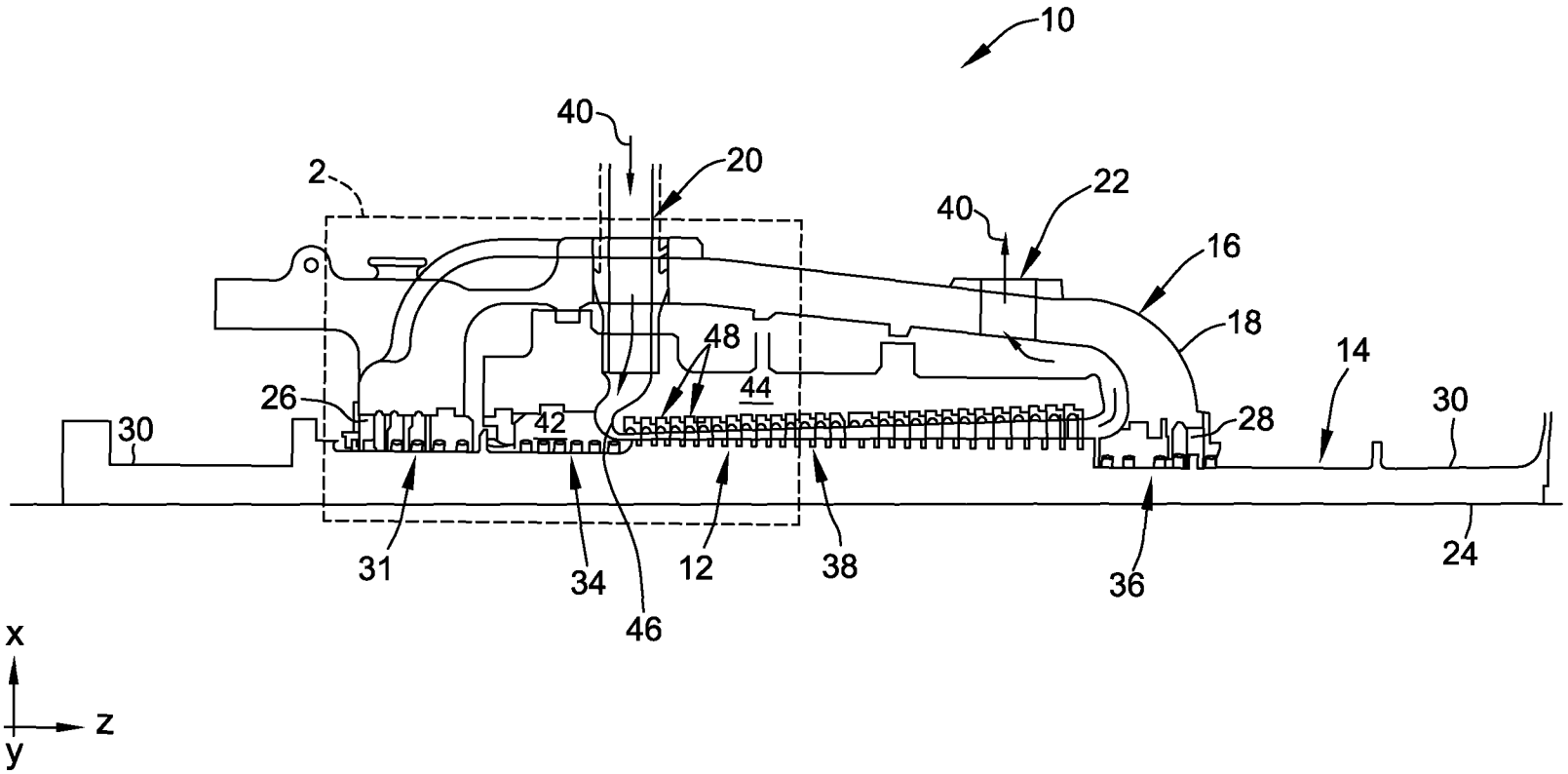
FIG. 1 is a schematic view of an exemplary steam turbine engine.

FIG. 1 is a schematic view of an exemplary steam turbine engine 10. While FIG. 1 describes an exemplary steam turbine engine, it should be noted that the bucket closure systems and methods described herein are not limited to any one particular type of turbine engine. One of ordinary skill in the art will appreciate that the current bucket closure systems and methods described herein may be used with any rotary machine, including a gas turbine engine, in any suitable configuration that enables such an apparatus, system, and method to operate as further described herein.

In the exemplary embodiment, steam turbine engine 10 is a single-flow steam turbine engine. Alternatively, steam turbine engine 10 may be any type of steam turbine, such as, without limitation, a low-pressure turbine, an opposed-flow, high-pressure and intermediate-pressure steam turbine combination, a double-flow steam turbine engine, and/or other steam turbine types. Moreover, as discussed above, the present invention is not limited to only being used in steam turbine engines and can be used in other turbine systems, such as gas turbine engines.

In the exemplary embodiment shown in FIG. 1, steam turbine engine 10 includes a plurality of turbine stages 12 that are coupled to a rotatable shaft 14. A casing 16 is divided axially into an upper half section 18 and a lower half section (not shown). The upper half section 18 includes a high pressure (HP) steam inlet 20 and a low pressure (LP) steam outlet 22. Shaft 14 extends through casing 16 along a centerline axis 24. Shaft 14 is supported in casing 16 by bearings 26 and 28, respectively, that are each rotatably coupled to opposite end portions 30 of shaft 14. A plurality of sealing members 31, 34, and 36 are coupled between rotatable shaft end portions 30 and casing 16 to facilitate sealing casing 16 about shaft 14.

In the exemplary embodiment, steam turbine engine 10 also includes a stator component 42 coupled to an inner shell 44 of casing 16. The plurality of sealing members 34 are coupled to stator component 42. Casing 16, inner shell 44, and stator component 42 each extend circumferentially about shaft 14 and sealing members 34. In the exemplary embodiment, sealing members 34 form a tortuous sealing path between stator component 42 and shaft 14. Shaft 14 includes a plurality of turbine stages 12 through which high-pressure high-temperature steam 40 is passed via one or more steam channel 46. The turbine stages 12 include a plurality of inlet nozzles 48. Steam turbine engine 10 may include any number of inlet nozzles 48 that enables steam turbine engine 10 to operate as described herein. For example, steam turbine engine 10 may include more or fewer inlet nozzles 48 than shown in FIG. 1. The turbine stages 12 also include a plurality of turbine blades or buckets 38. Steam turbine engine 10 may include any number of buckets 38 that enables steam turbine engine 10 to operate as described herein. For example, steam turbine engine 10 may include more or fewer buckets 38 than are illustrated in FIG. 1. Steam channel 46 typically passes through casing 16. Steam 40 enters steam channel 46 through HP steam inlet 20 and passes down the length of shaft 14 through turbine stages 12.

During operation, high pressure and high temperature steam 40 is channeled to turbine stages 12 from a steam source, such as a boiler (not shown), wherein thermal energy is converted to mechanical rotational energy by turbine stages 12. More specifically, steam 40 is channeled through casing 16 from HP steam inlet 20 where it impacts a plurality of turbine blades or buckets, generally indicated at 38, coupled to shaft 14 to induce rotation of shaft 14 about centerline axis 24. Steam 40 exits casing 16 at LP steam outlet 22. Steam 40 may then be channeled to the boiler (not shown) where it may be reheated or channeled to other components of the system, e.g., a condenser (not shown).

Figure 2:
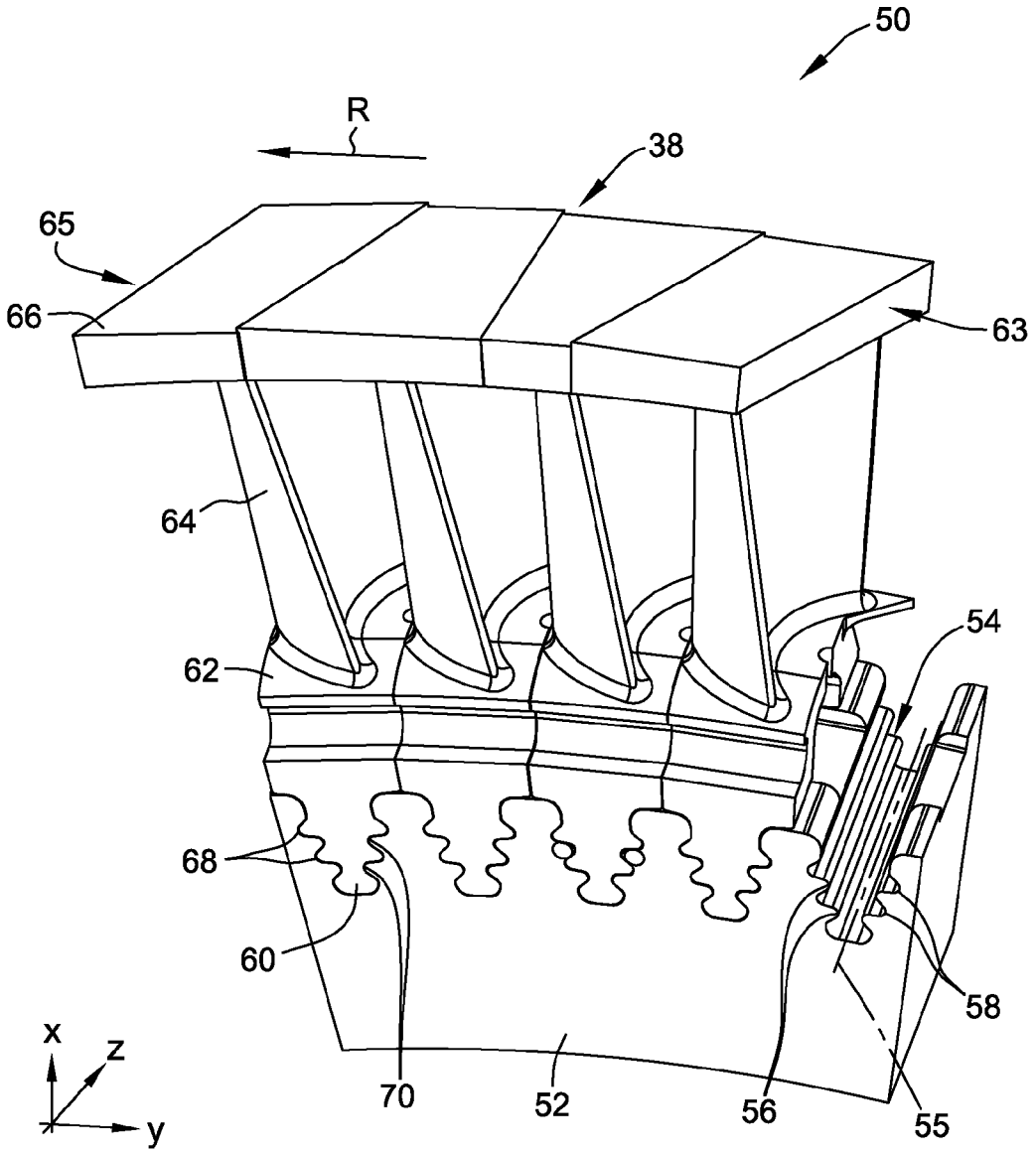
FIG. 2 is a perspective view of a portion of an exemplary rotor wheel assembly used with the steam turbine engine shown in FIG. 1.

FIG. 2 is a perspective view of a portion of an exemplary rotor wheel assembly 50 of steam turbine engine 10 shown in FIG. 1. In the exemplary embodiment, rotor wheel assembly 50 includes a rotor wheel 52 including a plurality of axial entry dovetail slots 54 defined therein that are substantially equi-spaced about the periphery of rotor wheel 52. Each dovetail slot 54 is substantially parallel to centerline axis 24 of shaft 30 as generally indicated by centerline 55. Centerline axis 24 corresponds to the axis of rotation of rotor wheel 52. In an alternative embodiment, dovetail slots 54 may be oriented in rotor wheel 52 at any angle relative to centerline axis 24 that enables steam turbine engine 10 to operate as described herein. Each dovetail slot 54 is generally V-shaped and includes a series of axially-extending projections 56 and grooves 58.

Centerline axis 24 is substantially parallel to the Z-axis of the coordinate system as shown in FIG. 1, wherein the primary flow direction of steam 40 is generally along the Z-axis. As shown in FIG. 2, rotor wheel 52 rotates in the direction indicated by arrow R as steam 40 flows though rotor wheel assembly 50.

In the exemplary embodiment, each bucket 38 includes a root portion or dovetail 60, a platform 62, an airfoil 64, and an integral cover 66. With reference to the coordinate system, the most forward circumferential side of each bucket 38 with respect to the direction of rotation of rotor wheel assembly 50 is referred to as a front side 65. The opposite circumferential side of each bucket 38, or the most rearward side with respect to the direction of rotation of rotor wheel assembly 50 (i.e., the positive direction of the Y-axis) is referred to as a back side 63.

In the exemplary embodiment, dovetail 60 is formed with a shape that is substantially complementary to a respective dovetail slot 54 and each includes tapered sidewalls that include a series of axially-extending projections 68 and grooves 70 that are configured to interlock with a respective dovetail slot 54. As described, dovetail slot 54 and dovetail 60 are aligned substantially parallel to centerline axis 24 of steam turbine engine 10, such that buckets 38 can be installed on rotor wheel 52 as dovetail 60 of a respective bucket 38 is inserted axially into a respective dovetail slot 54. When assembled, buckets 38 form an array of buckets that extend about the periphery of rotor wheel 52.

Figure 3:
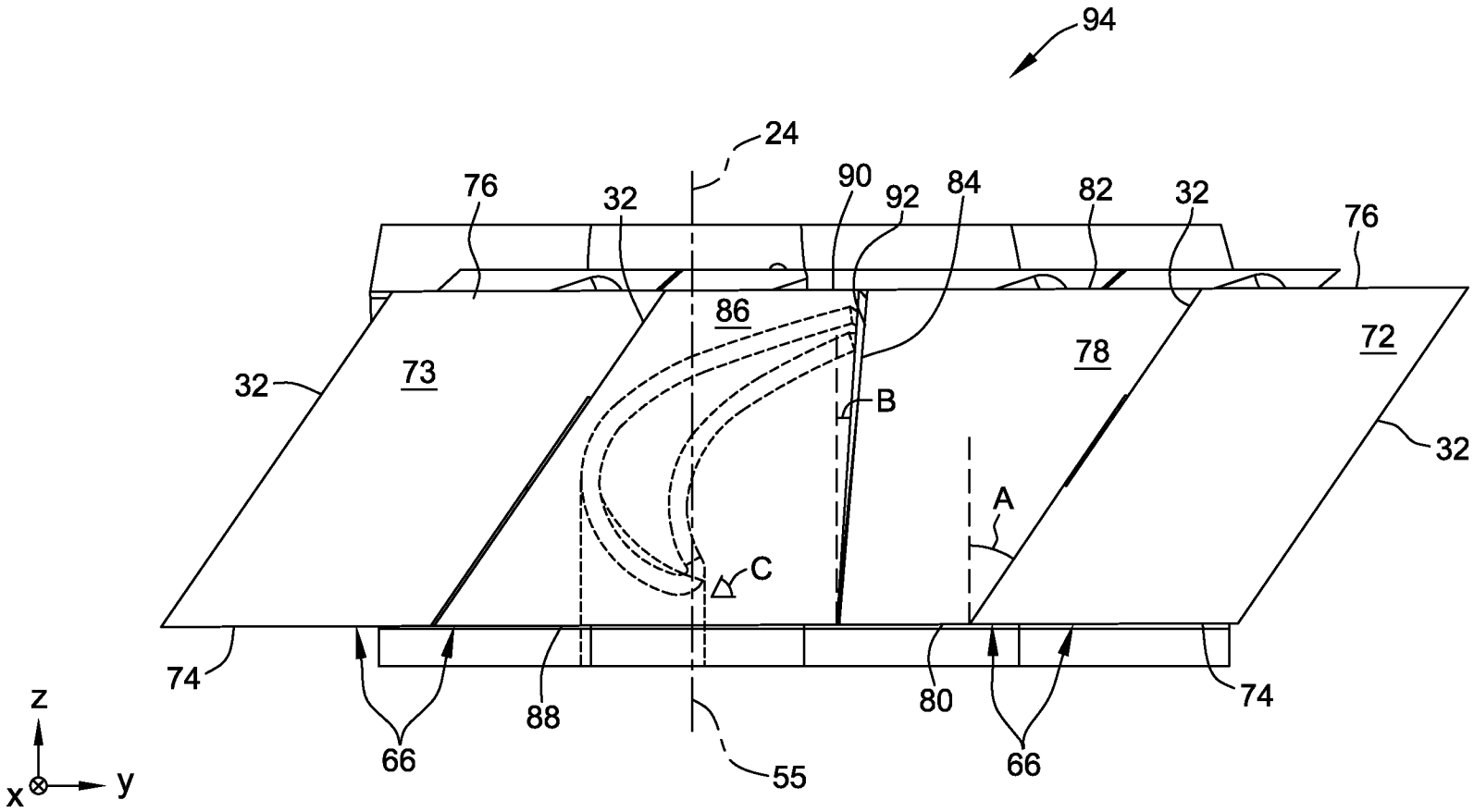
FIG. 3 is a top view of a portion of the rotor wheel assembly shown in FIG. 2 looking radially inwardly towards a centerline axis of the steam turbine engine.

FIG. 3 is a top view of a portion of rotor wheel assembly 50 looking radially inward at integral covers 66 and towards centerline axis 24. More specifically, FIG. 3 is an enlarged top view of an exemplary bucket closure assembly portion 94 used with rotor wheel assembly 50. In the exemplary embodiment, rotor wheel assembly 50 includes a plurality of regular buckets 72 and bucket closure assembly portion 94. Each integral cover 66 is generally formed in the shape of a parallelogram. Each integral cover 66 of regular bucket 72 includes outer edges 74 and 76 that are oriented substantially perpendicular to centerline axis 24 of rotor wheel 52 when each integral cover 66 is coupled in position within rotor wheel assembly 50. In addition, each integral cover 66 of regular bucket 72 includes a pair of circumferential edges 32 that are oriented substantially parallel to each other and each extends at an angle A with respect to centerline axis 24. In general, a respective circumferential edge 32 is located on front side 65 and back side 63 of regular bucket 72. In the exemplary embodiment, angle A is greater than about 0° and less than about 90°. Alternatively, angle A may be any angle that enables the plurality of buckets 38 to operate as described herein.

In the exemplary embodiment, bucket closure assembly portion 94 includes a leading auxiliary bucket 73. Leading auxiliary bucket 73 is similar to regular bucket 72. Bucket closure assembly portion 94 also includes a trailing auxiliary bucket 78. Integral cover 66 of trailing auxiliary bucket 78 is generally formed in the shape of a trapezoid and includes edges 80 and 82 that are substantially parallel to each other and are oriented substantially perpendicular to centerline axis 24 of rotor wheel 52 when rotor wheel assembly 50 is fully assembled. Trailing auxiliary bucket 78 includes a back side circumferential edge 32 that is oriented substantially parallel to a respective edge 32 of regular bucket 72 when rotor wheel assembly 50 is fully assembled. In addition, integral cover 66 of trailing auxiliary bucket 78 includes a front side circumferential edge 84 that is oriented at an angle B with respect to centerline axis 24. In the exemplary embodiment, angle B is an acute angle less than or equal to about 10° and greater than about 0°. In addition, angle B is smaller than angle A such that the expression $0° < |B| < |A|$ is met. Alternatively, angle B may be any angle that enables trailing auxiliary bucket 78 to operate as described herein.

In the exemplary embodiment, buckets 38 also include a closure bucket 86. Closure bucket integral cover 66 is generally formed in the shape of a trapezoid and includes edges 88 and 90 that are substantially parallel to each other and are oriented substantially perpendicular to centerline axis 24 of rotor wheel 52 when rotor wheel assembly 50 is fully assembled. Closure bucket 86 includes a front side circumferential edge 32 that is substantially parallel to a respective edge 32 of leading auxiliary bucket 73 when rotor wheel assembly 50 is fully assembled. In addition, closure bucket integral cover 66 includes a back side circumferential edge 92 that extends at an angle B with respect to the Z-axis and that is substantially parallel to front side circumferential edge 84 of trailing auxiliary bucket 78. As described above, angle B is a positive angle with respect to centerline axis 24 and is an acute angle that is smaller than angle A and that is greater than about 0° such that the expression $0° < |B| < |A|$ is satisfied.

In the exemplary embodiment, dovetail slot 54 and dovetail 60 are each aligned substantially parallel to centerline axis 24. Alternatively, dovetail slot 54 and dovetail 60 may be oriented at an angle C. In the exemplary embodiment, angle C is 0°. However, angle C may be any acute angle that satisfies the expression $|C| < |B| < |A|$. In alternative embodiments, angle C may be any angle that enables bucket closure assembly portion 94 to operate as described herein.

Figure 4:
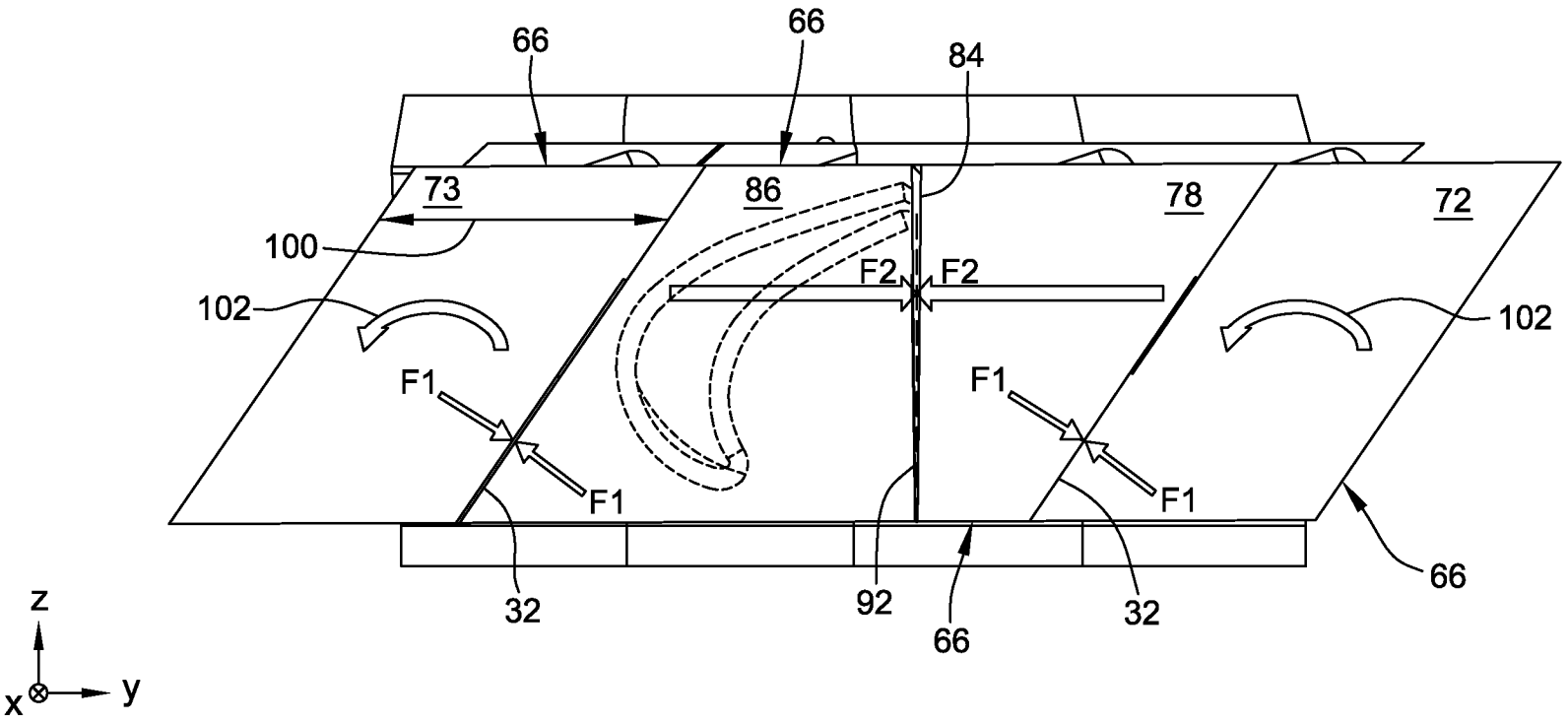
FIG. 4 is a top view of a portion of the rotor wheel assembly shown in FIG. 2 looking radially inwardly and illustrating exemplary contact forces that may act on the integral covers of a closure assembly portion.

FIG. 4 is a top view of a portion of rotor wheel assembly 50 looking radially inward and illustrating exemplary contact forces acting on integral covers 66 of bucket closure assembly portion 94. A circumferential width 100 of a respective integral cover 66 is fabricated with an increased tangential pitch as compared to the available space in rotor wheel assembly 50, i.e., the sum of the circumferential widths 100 of integral covers 66 is greater than the circumference of a circle extending through integral covers 66 of rotor wheel assembly 50. As a result, the circumferential width 100 creates an interference condition at circumferential edges 32 of integral covers 66. To relieve the interference condition, integral covers 66 are rotated to a smaller circumferential width 100 as indicated generally by curved arrows 102. The rotation creates a pre-twist of bucket airfoils 64. In the exemplary embodiment, each respective airfoil 64 acts as a torsional spring and frictional contact forces F1 are generated along circumferential edges 32 of integral covers 66. Frictional contact forces F1 ensure that each respective bucket 38 and bucket closure assembly portion 94 are coupled to each other. When closure bucket 86 is assembled, a frictional contact force F2 is also generated at the interface defined between circumferential edges 84 and 92 because of both the interference condition applied at this interface, and because of the tangential compression developed around the row due to airfoil 64 pre-twist. Closure bucket 86 is thus coupled to neighboring buckets 73 and 78. Because circumferential edges 84 and 92 are oriented at angle B, integral covers 66 do not slide in a gross manner relative to each other during service of steam turbine engine 10.

Figure 5:
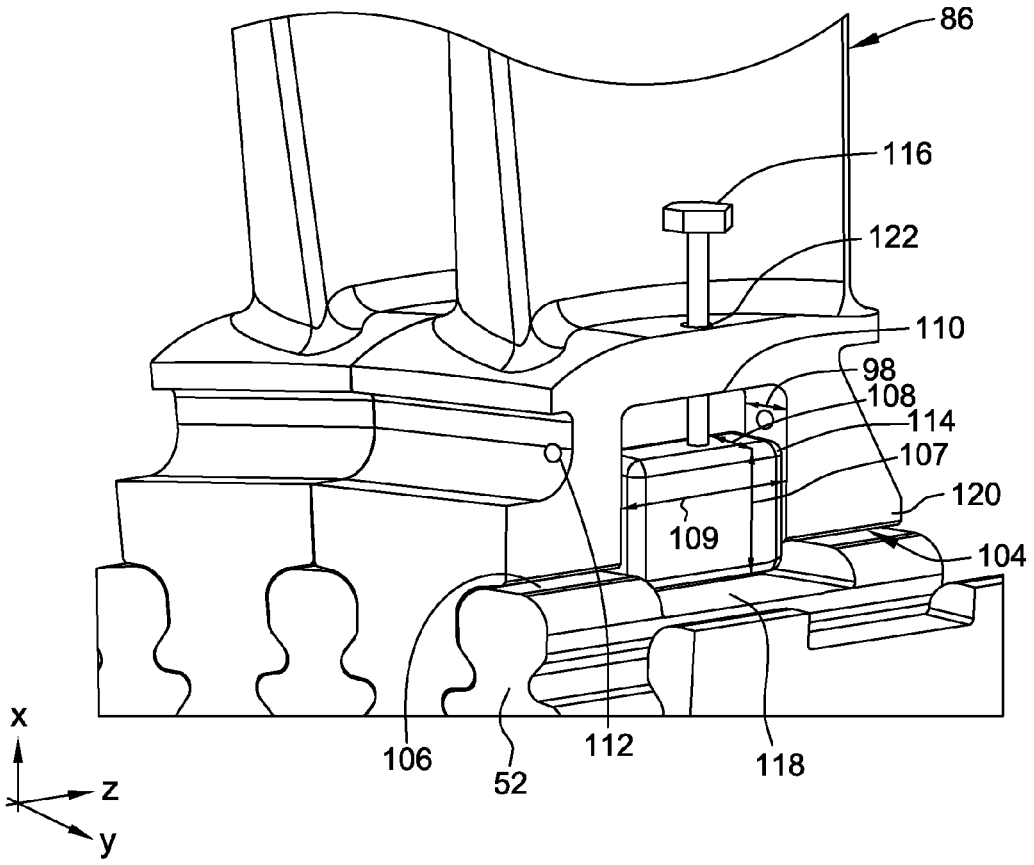
FIG. 5 is a partial perspective view of the rotor wheel assembly shown in FIG. 2 illustrating an exemplary retaining key for securing a closure bucket.

FIG. 5 is a partial perspective view of rotor wheel assembly 50. In the exemplary embodiment, closure bucket 86 includes a keyway 110 defined in a back side 96 of platform 62. Keyway 110 is generally rectangular in shape and extends a predetermined distance 98 below a back side surface 120 of platform 62. Alternatively, keyway 110 may be any shape that enables keyway 110 to operate as described herein. Keyway 110 is generally centered within platform 62 in an axial direction and extends through a bottom surface 104 of platform 62. Rotor wheel 52 includes a corresponding notch 118 defined in a peripheral surface 106 of rotor wheel 52 between respective dovetail slots 54. Notch 118 is substantially aligned with keyway 110, i.e., both keyway 110 and notch 118 have a substantially similar dimension in the Z-axis direction.

In the exemplary embodiment, a retaining key 114 is positioned within keyway 110 and notch 118 to secure the axial location of closure bucket 86. Key 114 is substantially rectangular in shape and has a predetermined thickness 108 that is smaller than distance 98 of keyway 110 to enable closure bucket 86 to be inserted as the last bucket onto rotor wheel assembly 50 without key 114 interfering with trailing auxiliary bucket 78. Alternatively, key 114 may be any shape that enables key 114 to operate as described herein. Key 114 has a width 109 and a height 107 that enable key 114 to substantially align with the dimensions of keyway 110 and notch 118 while enabling key 114 to move vertically within keyway 110 and notch 118.

In the exemplary embodiment, platform 62 includes an opening 112 extending therethrough. Opening 112 extends generally axially through platform 62 and is substantially parallel to centerline 24 of steam turbine engine 10 (Shown in FIG. 1). Opening 112 extends through keyway 110 to enable key 114 to be secured therein. Platform 62 also includes an opening 122 defined therein that extends vertically in a radial direction with respect to rotor wheel assembly 50. Opening 122 enables a rod 116 (e.g., without limitation, a bolt) to be extended therethrough for positioning key 114 within notch 118.

Figure 6:
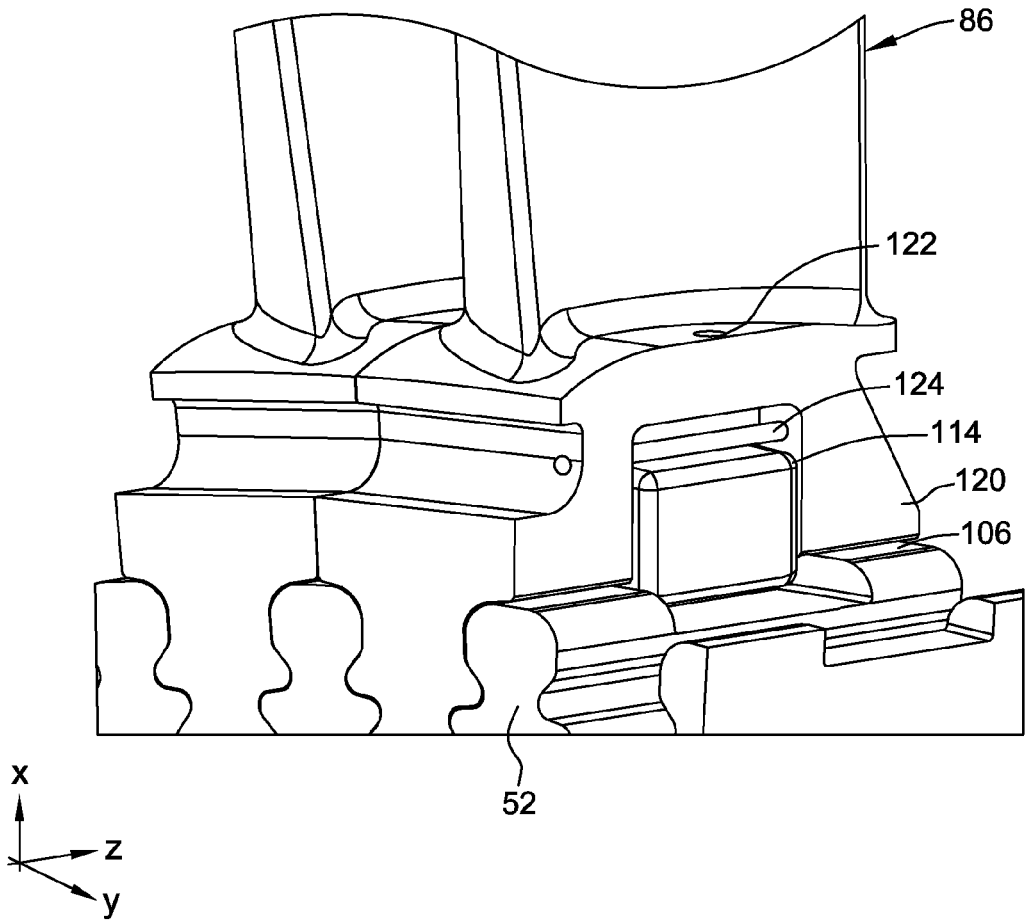
FIG. 6 is a partial perspective view of the rotor wheel assembly shown in FIG. 2 including an exemplary retaining pin that may be used to secure the retaining key used with the closure bucket.

FIG. 6 is a partial perspective view of rotor wheel assembly 50 including an exemplary retaining pin 124 that may be used to secure key 114. In the exemplary embodiment, retaining pin 124 is inserted into opening 112 for securing key 114 in a radially inward position therein. Alternatively, retaining pin 124 may be any type of retaining mechanism that secures key 114 as described herein, including for example, a spring pin, a dowel pin, and/or a threaded fastener.

In operation, trailing auxiliary bucket 78 is inserted into dovetail slot 54 of rotor wheel 52 and secured in place with a retaining key (not shown). Alternatively, auxiliary bucket 78 may be secured in place by any conventional means used for securing rotor buckets, for example, without limitation, by use of a twist-lock retainer. Regular bucket 72 is inserted into an adjacent dovetail slot 54 of rotor wheel 52 and, likewise, is secured in place. An additional regular bucket 72 is subsequently inserted into an adjacent dovetail slot 54 of rotor wheel 52 and secured in place, working around rotor wheel 52 until two dovetail slots 54 remain. Leading auxiliary bucket 73 is inserted in the second to last dovetail slot 54 and secured in place. Trailing auxiliary bucket 78 and leading auxiliary bucket 73 are spread apart to form an opening for closure bucket 86. Closure bucket 86 is inserted into the last dovetail slot 54. To spread trailing auxiliary bucket 78 and leading auxiliary bucket 73 apart, a first substantially tangential force is applied to trailing auxiliary bucket 78 in a direction away from leading auxiliary bucket 73, and a second substantially tangential force is applied to leading auxiliary bucket 73 in the opposite direction. Spreading trailing auxiliary bucket 78 and leading auxiliary bucket 73 apart is necessary because the relationship between angles A, B, and C is such that it meets the expression $|C|<|B|<|A|$. This relationship, along with circumferential width 100 of integral covers 66, assures that closure bucket 86 cannot be inserted into rotor wheel 52 without first spreading the opening defined between trailing auxiliary bucket 78 and leading auxiliary bucket 73, thus locking each of the buckets in place after final assembly of closure bucket 86.

In the exemplary embodiment, closure bucket 86 is assembled with key 114 in the radial outward position, captured entirely within keyway 110. After closure bucket 86 is inserted into dovetail slot 54 of rotor wheel 52, rod 116 is used to move key 114 to a radially inward position. Key 114 is positioned to engage both keyway 110 and notch 118 simultaneously. Rod 116 is removed from opening 122, and retaining pin 124 is inserted into opening 112 to secure key 114 in the engaged position.

The systems and methods described herein facilitate improving turbine engine performance by providing an axial entry bucket system that substantially reduces operating stresses induced to the turbine. Specifically, a closure bucket and trailing auxiliary bucket with a unique integral cover interface is described. The closure bucket may be assembled on or disassembled from a rotor wheel in an axial manner without the use of a dovetail insert or other similar retaining mechanism. Therefore, in contrast to known turbines that use axial entry buckets, the apparatus, systems, and methods described herein facilitate reducing the time and difficulty in assembling axial entry buckets with integral covers, and facilitate reducing operating stresses and cost associated with dovetail closure inserts.

The methods and systems described herein are not limited to the specific embodiments described herein. For example, components of each system and/or steps of each method may be used and/or practiced independently and separately from other components and/or steps described herein. In addition, each component and/or step may also be used and/or practiced with other assemblies and methods.

While the invention has been described in terms of various specific embodiments, those skilled in the art will recognize that the invention can be practiced with modification within the spirit and scope of the claims.

What is claimed is:

1. A rotor wheel assembly comprising:

a rotor wheel comprising a plurality of dovetail slots spaced circumferentially about a periphery of said rotor wheel; and a closure bucket coupled to said rotor wheel, said closure bucket comprising:

an airfoil portion;

a platform portion comprising a keyway defined within a radially extending surface of said platform portion;

an opening defined in and extending through said closure bucket and extending through said keyway;

a dovetail configured to couple to a respective one of said plurality of dovetail slots;

a retaining key sized to be received within said keyway such that said retaining key is recessed in a circumferential direction from said radially extending surface; and a retaining pin configured to slidably couple to said opening, said retaining pin coupled radially outward of said retaining key and further configured to secure said retaining key within said keyway.

2. A rotor wheel assembly in accordance with claim 1, wherein said plurality of dovetail slots is oriented at an angle relative to said axis of rotation.

3. A rotor wheel assembly in accordance with claim 2, wherein said plurality of dovetail slots comprise axial entry dovetail slots, such that said angle is approximately 0°.

4. A turbine engine comprising:

a rotatable shaft having an axis of rotation;

a casing extending circumferentially about said rotatable shaft, said casing defining at least one passage configured to channel a working fluid along a length of said rotatable shaft;

a rotor wheel assembly coupled to a portion of said rotatable shaft for rotation therewith, said rotor wheel assembly configured to expand the working fluid, said rotor wheel assembly comprising:

a rotor wheel comprising a plurality of dovetail slots spaced circumferentially about a periphery of said rotor wheel;

a plurality of buckets arranged in a circumferential array about said axis of rotation, each respective bucket of said plurality of buckets comprising a dovetail configured to couple to a respective one of said plurality of dovetail slots, a platform portion, and an airfoil portion, wherein one of said plurality of buckets comprises a closure bucket comprising:

a dovetail configured to couple to a respective one of said plurality of dovetail slots;

a platform portion comprising a keyway defined within a radially extending surface of said platform portion;

an opening defined in and extending through said closure bucket, and extending through said keyway;

an airfoil portion;

a retaining key sized to be received within said keyway such that said retaining key is recessed in a circumferential direction from said radially extending surface; and a retaining pin configured to slidably couple to said opening, said retaining pin coupled radially outward of said retaining key and further configured to secure said retaining key within said keyway.

5. A turbine engine in accordance with claim 4, wherein said bucket closure assembly further comprises a leading auxiliary bucket comprising a dovetail configured to couple to a respective one of said plurality of dovetail slots.

6. A turbine engine in accordance with claim 4, wherein said plurality of dovetail slots is oriented at a angle relative to said axis of rotation.

7. A turbine engine in accordance with claim 6, wherein said plurality of dovetail slots comprise axial entry dovetail slots, such that said angle is approximately 0°.

8. A rotor wheel assembly in accordance with claim 1, wherein said keyway has a width extending substantially parallel to an axis of said rotor wheel, said retaining key has a width extending substantially parallel to the axis that substantially corresponds to said width of said keyway.

9. A rotor wheel assembly in accordance with claim 1, wherein said keyway extends to a depth within said platform portion, said retaining key has a thickness normal to said surface that is less than said keyway depth.

* * * * *